United States Patent [19]

Stenger

[11] 3,978,672

[45] Sept. 7, 1976

[54] GAS OPERATED ENGINE

[75] Inventor: Joseph D. Stenger, Brooklyn, N.Y.

[73] Assignee: Propulsion Machinery Corporation, Brooklyn, N.Y.

[22] Filed: Dec. 5, 1973

[21] Appl. No.: 422,019

[52] U.S. Cl. ..... 60/670; 92/60.5; 92/13.1; 92/13.6; 123/90.17

[51] Int. Cl.[2] ..... F01B 7/20; F01B 25/00

[58] Field of Search ..... 60/670, 671; 92/60.5, 92/60, 13.1, 13.6; 123/90.18, 1 A, 90.15, 90.17

[56] References Cited

UNITED STATES PATENTS

| | | | |
|---|---|---|---|
| 1,044,096 | 11/1912 | Sorg | 123/75 B |
| 1,519,640 | 12/1924 | Swehla | 123/90.18 |
| 2,429,035 | 10/1947 | Steving | 60/645 |
| 2,478,790 | 8/1949 | Stephens | 92/13.1 X |
| 2,884,908 | 5/1959 | Campbell | 123/1 X |
| 3,168,853 | 2/1965 | Prince | 92/13.1 X |
| 3,344,600 | 10/1967 | Eddy | 60/670 |
| 3,638,624 | 2/1972 | O'Grady | 123/90.18 |
| 3,730,150 | 5/1973 | Codner, Jr. | 123/90.18 |

FOREIGN PATENTS OR APPLICATIONS

| | | | |
|---|---|---|---|
| 1,109,790 | 9/1955 | France | 123/90.17 |

*Primary Examiner*—Allen M. Ostrager
*Attorney, Agent, or Firm*—J. B. Felshin

[57] ABSTRACT

This is a multi-cylinder engine with a main piston and an auxiliary piston in each cylinder. The main piston is operated by means of compressed gas as a propellant. The auxiliary piston is operated by a hydraulic system controlled by movement of the main piston, and by a valve in the hydraulic system also controlled by movement of said main piston. The engine can have four engine cylinders. Compressed gas is sequentially applied to the cylinders for about 90° rotation of the crank shaft for each cylinder. The angular degree of rotation of the crank shaft during which compression gas is delivered to the individual cylinders can be varied while the engine keeps operating. Liquid gas vaporizes to gaseous state for use in the engine.

31 Claims, 15 Drawing Figures

GAS OPERATED ENGINE

This invention relates to engines which may be used to motorize vehicles.

An object of this invention is to provide an engine of the character described comprising a plurality of engine cylinders, with a main piston in each cylinder, and with all the main pistons being connected to a common crank shaft, with compressed gas means to sequentially move said pistons, each cylinder having an auxiliary piston above the main piston, oil pump means to move said auxiliary pistons and means controlled by said compressed gas, to operate said oil pump means.

Another object of this invention is to provide an engine of the character described having means to vary the degree of rotation of the crank shaft during which compressed gas is delivered to the cylinders, while the engine keeps on operating.

Yet another object of this invention is to provide an engine of the character described using liquid gas for propellant, and which can be used in an automotive vehicle and which has no exhaust, creates no polutants, which engine operates cold, needs no warm up for starting, which is so constructed that when the vehicle stops for traffic, there is no waste of power, which engine is not affected by heat or cold, has no electrical system for starting up, and in which the gas is not explosive and is nonflammable and safe to use.

Still another object of this invention is to provide an engine of the character described which shall be economical to operate, safe in use and which shall yet be practical and efficient to a high degree in use.

Other objects of this invention will in part be obvious and in part hereinafter pointed out.

The invention accordingly consists in the features of construction, combinations of elements, and arrangement of parts which will be exemplified in the construction hereinafter described and of which the scope of invention will be indicated in the following claims.

IN THE DRAWINGS

Figure 6:
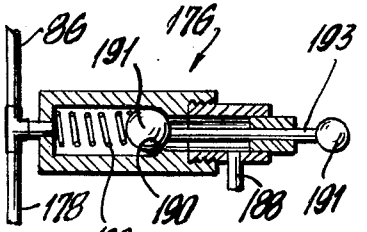
Figure 7:
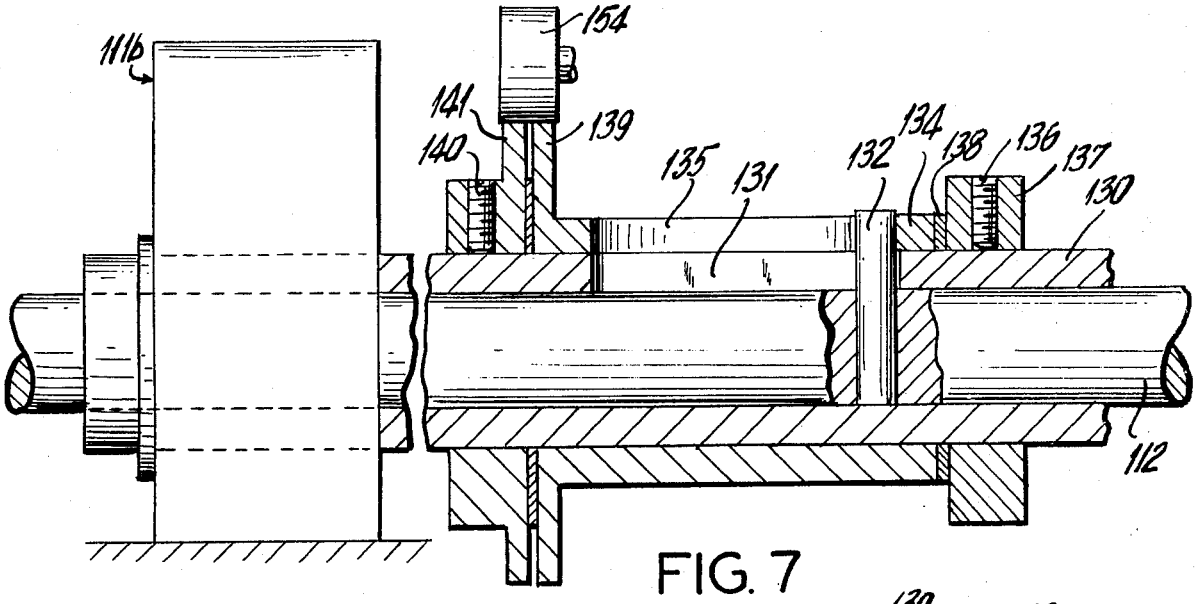
Figure 8:
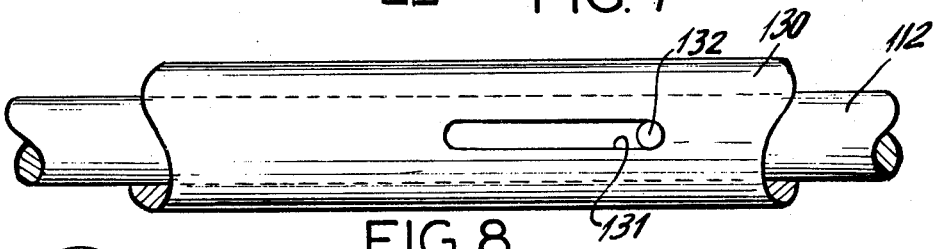
Figure 9:
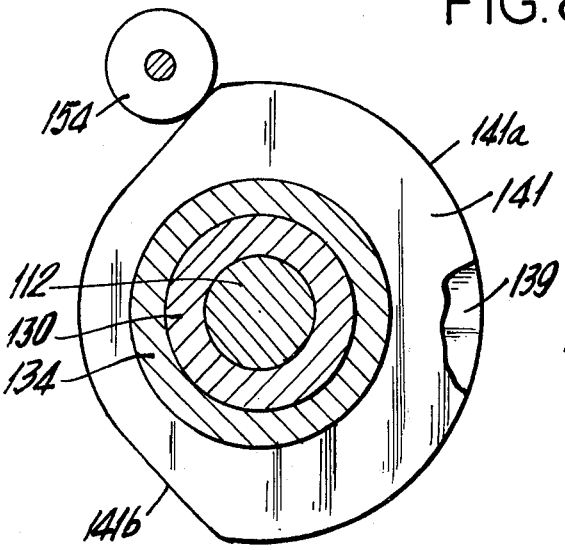
Figure 10:
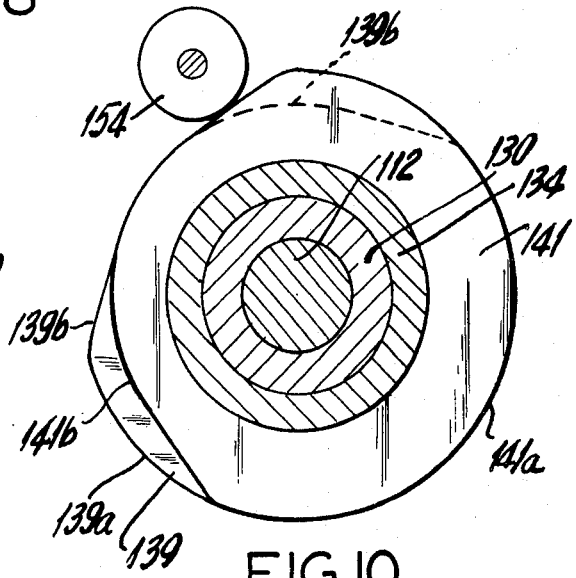
Figure 11:
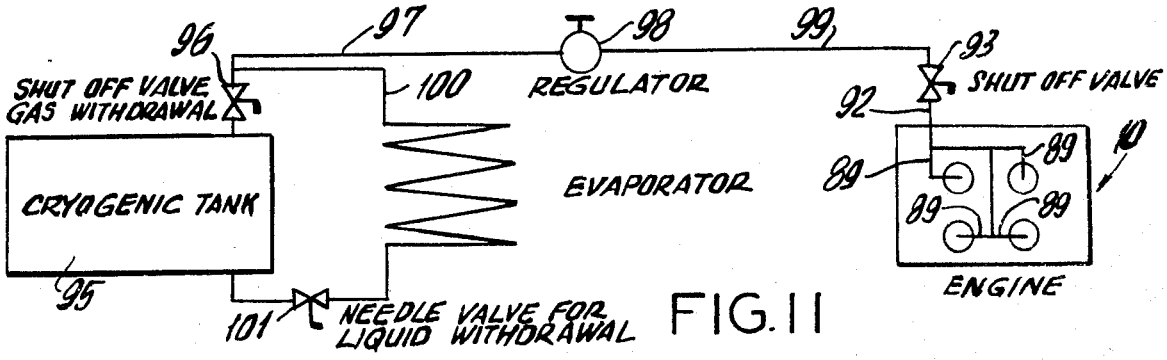

FIGS. 5*a*, 5*b*, 5*c*, 5*d* and 5*e* are diagrammatic views showing one cylinder in successive 45° angular positions of the crank shaft it rotates;

FIG. 6 is a cross-sectional view of a valve in the oil system for controlling flow of oil to a chamber for the auxiliary piston to move in, and to an oil reservoir;

FIG. 7 is a partial cross-sectional view of a cam assembly for an oil valve;

FIG. 8 is a partial side view of the sleeve which carries one of the cams of the cam assembly of FIG. 7;

FIG. 9 is a transverse sectional view of the cam assembly with the pair of cams for each gas valve in one relative angular relation;

FIG. 10 is a view like FIG. 9 but showing the cams of one cam assembly with both cams of the cam assembly in registry; and FIG. 11 is a diagram for the cryogenic tank, evaporator and oil line to the engine.

Figure 1:
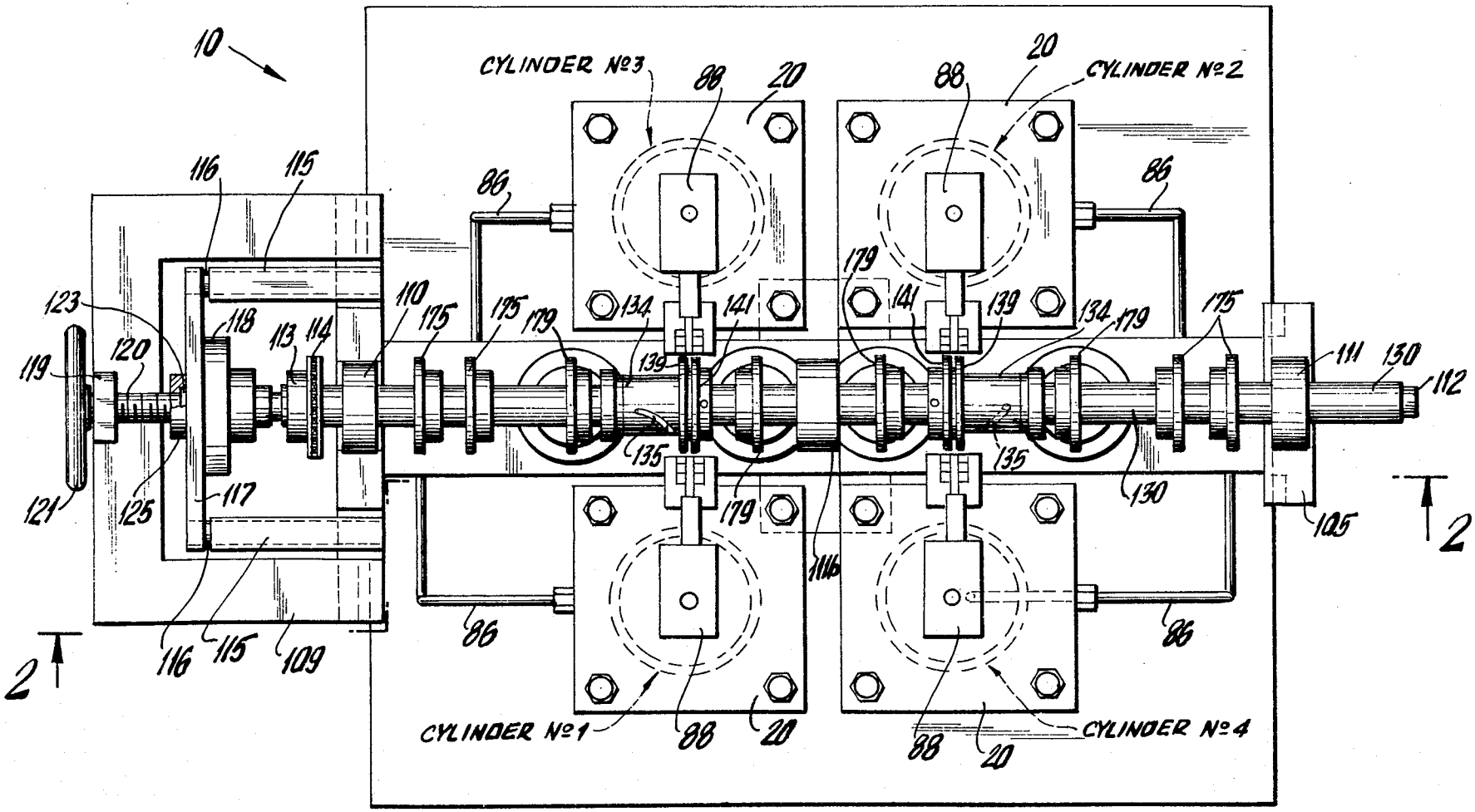
FIG. 1 is a top view of an engine embodying the invention.
Figure 3:
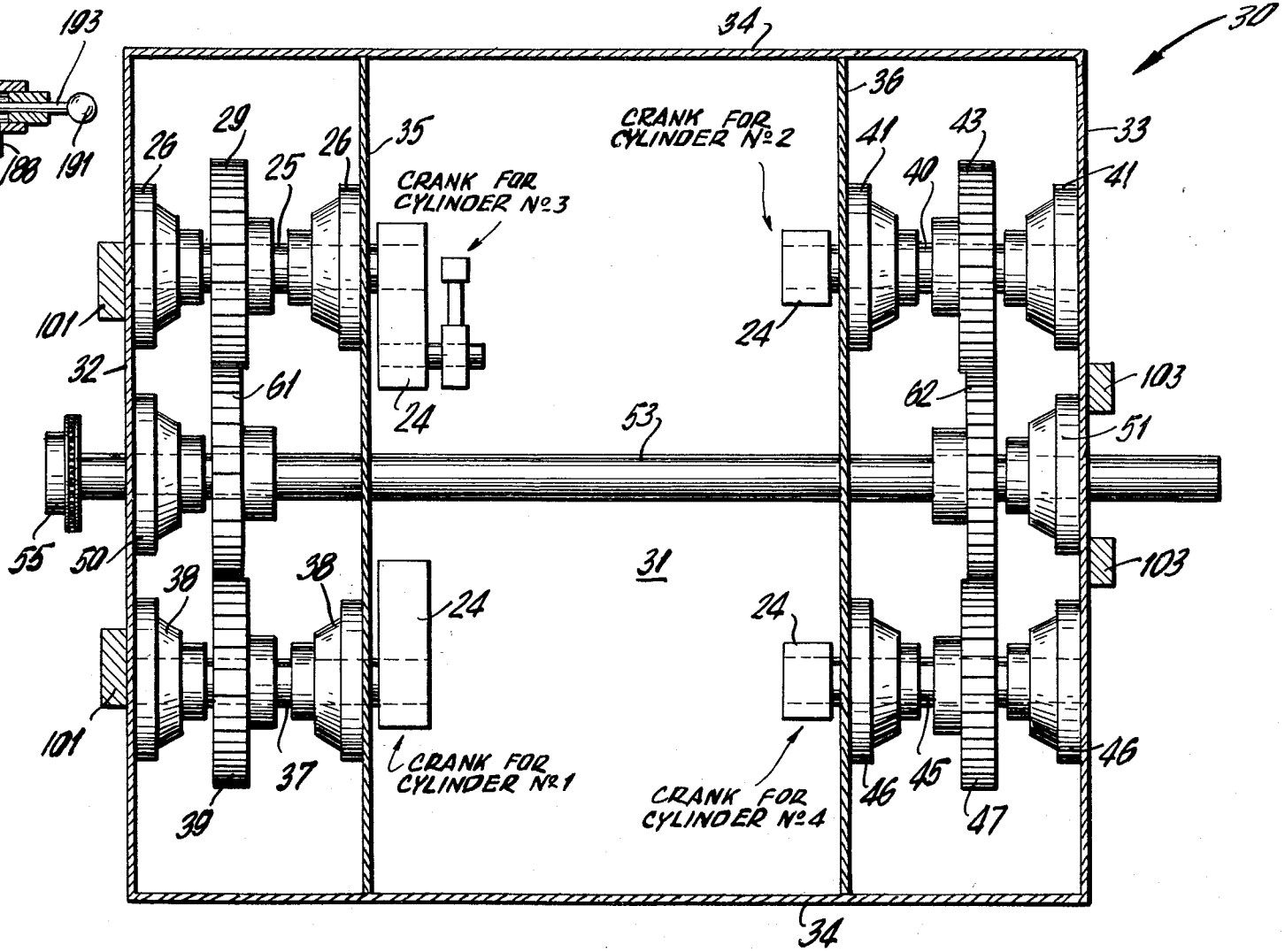
FIG. 3 is a cross-sectional view taken on line 3—3 of FIG. 2.

Referring now in detail to the drawing, numeral 10 designates an engine embodying the invention. Said engine 10 comprises four similar engine cylinders 1, 2, 3, 4 arranged in a pair of rows. Cylinders 3 and 2 are in one row and they are aligned with cylinders 1 and 4, respectively, in another row, as shown in FIGS. 1 and 3. The sequence of power strokes for said cylinders is cylinders 1, 2, 3, 4. Each cylinder comprises a cylindrical wall 12 mounted on a bottom plate 13, into a recess of which the lower end of the cylinder fits. The inner surface 14 of cylindrical wall 12 registers with an annular hole 15 in plate 13. The plates 13 for the cylindrical walls 12 are suitably mounted on a horizontal support. Mounted on top of each cylindrical wall 12 is a plate 17 recessed at its underside to receive the upper end of said cylindrical wall and having a hole 18 registering with the inner surface of said cylindrical wall. On top of each plate 17 is a top plate 20. Plates 20, 17 are bolted to plate 13. Plates 20, 17 are bolted to plate 13 by tie rods or bolts 21. Slidable in each cylindrical wall 12 is a main piston 22, connected by a pivoted connecting rod 23 to a crank 24. Crank 24 of cylinder 3 rotates a shaft 25 (FIG. 3) rotatably mounted in bearings 26 and carrying a pinion 29 fixed thereto. Beneath the plate 13 is a crank case 30 comprising a bottom wall 31, a front wall 32, a rear wall 33 and side walls 34. Side walls 34 are interconnected by transverse vertical partition walls 35, 36. Said bearings 26 are mounted on walls 32, 35, respectively.

The crank 24 for cylinder 1 rotates a shaft 37 journalled in bearings 38 mounted on walls 32, 35 of the crank case. Shaft 37 is parallel to shaft 25 and carries a pinion 39 similar to pinion 29.

The crank 24 for cylinder 2 rotates a shaft 40 journalled in bearings 41 mounted on walls 36, 33 of the crank case 30. Shaft 40 carries a pinion 43. Shafts 25, 40 are coaxial. Pinion 43 is similar to pinions 29, 39.

The crank 24 for cylinder 4 rotates a shaft 45 journalled in bearings 46 mounted on walls 36, 33, respectively. Shaft 45 carries pinion 47 similar to pinion 43 and aligned therewith. Shafts 37 and 45 are coaxial. Pinions 29, 39 are similar and aligned. Pinions 43, 47 are similar and aligned.

On walls 32, 33 are mounted bearings 50, 51, respectively, centrally disposed between bearings 26, 38 and 41, 46. Journalled in bearings 50, 51 is an output crank shaft 53, parallel to shafts 25, 37, 40, 45 and disposed at the same level. The cranks 24 for cylinders 3 and 1 extend horizontally inwardly of shafts 25, 37 respectively, in one position of the main pistons of said cylinders. In such position, crank 24 of cylinder 2 projects downwardly and the crank 24 of cylinder 4 projects upwardly.

Shaft 53 projects through the crank case walls 32, 33. On said shaft 53, spaced forwardly of wall 32, is mounted a sprocket wheel 55.

Crank case 30 has a top wall 60. Fixed to shaft 53 is a gear 61 meshing with and similar to pinions 29, 38, and another gear 62 meshing with and similar to pinions 43, 47. It will now be understood that when the cylinders are pressured, in sequence, each through about 90° of its crank rotation, the crank shaft 53 will be continuously rotated. The crank 24 of each cylinder is power rotated through substantially ¼ of a revolution of its crank shaft and is dragged through the other ¾ of each revolution, to thus provide for continuous rotation of the output shaft 53 in the manner hereinafter described.

In each cylinder, there is attached to the underside of top wall 20, as by fasteners 70, an axial, downwardly opening sleeve 71. Slidable in sleeve 71 is a piston 72 having a downwardly extending stem 73. Fixed on stem 73 and to the underside of piston 72 is an auxiliary piston 74 slidable in cylindrical wall 12. Screwed to piston 74 are rods 75 passing up through holes 76 in top plate 20. A stop collar 77 is held on the upper end of each rod 75 by a nut 78 screwed to the upper end of each rod. Rods 75 limit downward movement of said auxiliary piston 74. Extending up from piston 72 is an axial stem 80 projecting up through an axial opening 81 in top wall 20. An O-ring 82 is interposed between piston 72 and the inner surface of sleeve 71. An axial through hole 83 is formed in piston 72 and stems 73, 80. Top wall 20 is formed with a passage 85 (see FIG. 5*a*) connecting an oil pipe 86 with the interior of chamber or sleeve 71, for the purpose hereinafter appearing.

Figure 4:
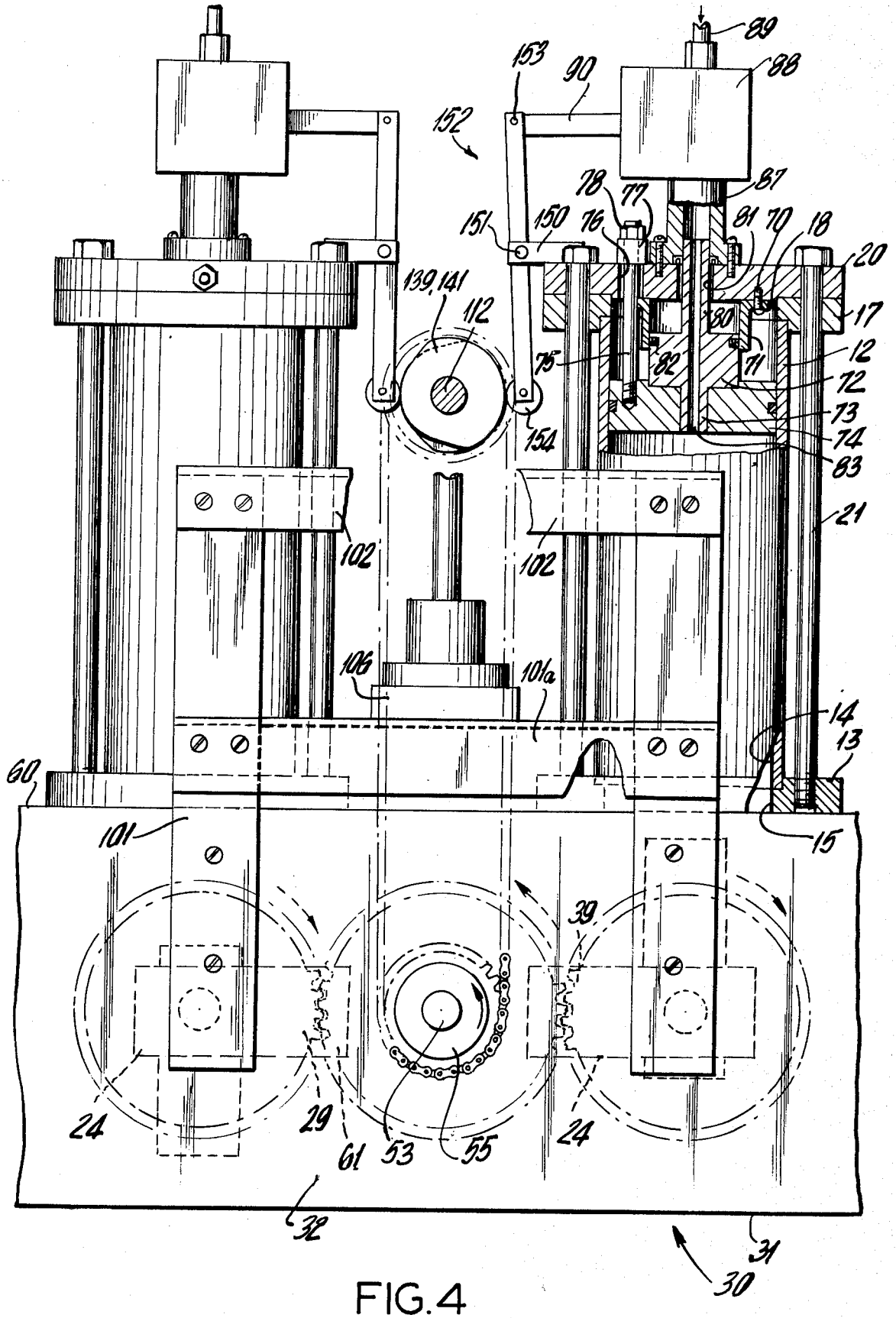
FIG. 4 is a view looking to the right from substantially the left end of FIG. 2.

Fixed to the upper side of top wall 20 is a pipe 87 extending upwardly. At the upper end of pipe 87 is a gas valve 88 to which a compressed gas inlet pipe 89 is connected. Said valve 88 is provided with means to open the valve when rod 90 is drawn in, as shown in FIG. 4, and to close and prevent passage of the gas to pipe 87 and hence to passage 83, when said rod 90 is drawn out.

As shown in FIG. 11, the gas inlet pipes 89 are interconnected and connect to a pipe 92 which leads to a shut off valve 93. Compressed gas from a cryogenic tank 95 passes through a shut-off valve 96 connected by pipe 97 to a regulator 98, which in turn is connected by pipe 99 to the shut-off valve 93. Liquid gas from the tank 95 circulates by piping 100 through an evaporator and back to the tank through a needle valve 101 by means of which liquid from the tank 95 can be withdrawn. When compressed gas passes through passage 83, it will cause the main piston to move down.

Means is provided to control the gas valves 88. To this end, there is fixed to the front end of the crank case, a pair of uprights 101 supporting a lower angle shaped cross-bar 101*a* and an upper angle shaped cross-bar 102. At the rear end of the crank case are a pair of uprights 103 supporting a lower angle shaped cross-bar 104 and an upper angle-shaped cross-bar 105. Supported on bars 101*a*, 104 is an elongated longitudinal, horizontal plate 106 disposed above the top wall 60 of the crank case. Supported on uprights 101 is a brace 108 supporting a horizontal platform 109. On cross bar 102 is a bearing 110. On cross-bar 105 is a bearing 111. On a suitable center support 111*a*, is a bearing or pillow block 111*b*. Rotatably supported on bearings 110, 111, 111*b* is a longitudinal horizontal sleeve shaft 130 surrounding an inner shaft 112. On shaft 130 is a sprocket wheel 113 vertically aligned with sprocket wheel 55 on shaft 53. Sprocket wheels 53, 113 are similar. A sprocket chain 114 meshes with the sprocket teeth of sprocket wheels 55, 113. Thus, output shaft 53 drives the cam shaft 130 at same speed as shaft 53.

Means is provided to adjustably move the cam shaft 130 axially for the purpose hereinafter appearing. To this end there is fixed to support 109 in any suitable manner, a pair of fixed horizontal, longitudinally extending sleeves 115 in which are telescoped rods 116 interconnected at their front ends by a cross-bar 117 carrying a bearing 118. The front end of shaft 112 is reduced in diameter and journalled in the bearing 118. Fixed on platform 109 is an internally threaded member 119 in which is screwed a threaded rod 120. A wheel 121 for turning the screw rod, is fixed to the front end of said rod. The rear end of the rod has a collar 123 rotatably received in a socket in the front enlarged head 125 of shaft 112. Thus, rotation of the wheel 121 will axially move shaft 112 either to the right or left, looking at FIG. 1, depending on the direction of rotation of the wheel 121 and of the screw rod 120.

Said shafts 112, 130 are disposed parallel to and directly above shaft 53, and lie between cylinders 3 and 2 which are on one side of said shafts, and cylinders 1 and 4, which are on the opposite sides of said shafts. Said shaft 112 is disposed below the upper ends of said cylinders as shown in FIG. 4 and hence between the gas valves 88 of the cylinder 3 and 2 which are on one side, and the cylinders 1 and 4 which are on the other side. Means is mounted on said shaft 130 to actuate said gas valves. To this end sleeve 130 (see FIG. 7,8) is formed with a pair of longitudinal slots 131. On shaft 112 are fixed radial pins 132 passing through said slots 131. Thus sleeve 130 rotates together with shaft 112 but permits said shaft to move axially relative to said sleeve. On sleeve 130 are a pair of similar symmetrical sleeves 134 each formed with a helical slot 135 crossing longitudinal slot 131 in said sleeve 130. The helical slot 135 in the sleeve 134 on the right side (FIG. 1) lags 90° with respect to the slot 135 of the sleeve 134 on the left side (FIG. 1). The pins 132 which pass through slots 131 in sleeve 130 also pass into helical slots 135 which cross said slots. Fixed by set screws 136 to sleeve 130 are thrust collars 137 located at the outer ends of sleeves 134. A thrust washer 138 is interposed between each sleeve 134 and its collar 137. At the inner end of each sleeve 134 is a cam 139. Fixed on sleeve 130 as by set screws 140. At the inner side of each cam 139 is a cam 141. Cams 139, 141 may be of same outer edge contour. Both have part-circular edges 139*a*, 141*a*, respectively, and similar cammed depressed edges 139*b*, 141*b* of more than 90°, respectively. Each set of cams 139, 141 combine to form a single cam. The angular extent of the depressed portion of each pair of assembled cams 130, 141 may be varied by moving the shaft 112 axially, which causes the cams 139 to rotate relative to the cams, 141. In addition of course, the assembled cams rotate together with the sleeve 130 and shaft 112 under influence of rotation of the output shaft 53. The effective parts of the cams can be reduced to less than 90° by moving the cam shaft 112 to the left, looking at FIG. 1.

The set of cams 139, 141 on the left of FIG. 1 lie between the gas valves 88 of cylinders 1 and 3 and the set of cams 139, 141 on the right of FIG. 1 lie between the gas valves 88 of cylinders 4 and 2. The angular adjustment of sleeve 130 permits varying the effective angle of rotation of shaft 112 (and output shaft 53) during which the cams 139, 141 open the gas valves 88. One valve 88 must be always open to start the engine, when valves 96 and 93 are open (FIG. 11). By adjusting wheel 121, the effective angle of cams 139, 141 may be enlarged to open one of the valves 88 to start the engine. Thereafter the effective angle of said cams, for pressure, may be curtailed. Inertia and expansion of the gas in the cylinder's will keep the engine running thereafter.

Fixed to top plate 20 of cylinder 1 is an arm 150. Pivoted to arm 150, as at 151 is a lever 152. The upper end of lever 152 is pivoted as at 153, to the inner end of valve actuator 90. At the lower end of lever 152 is a roller or follower 154 contacting the edges of the combined cams 139, 141.

It will now be understood that one set of cams 139, 141 are disposed between the rollers of the gas cylinders 1 and 3 and the other set of cams are disposed between the gas valves of cylinders 2 and 4. The cams between cylinders 1 and 3 actuate the gas valves of said cylinders for about 90° angles of rotation (depending on degree of adjustment), phased 180° apart. The same is true of the cams 139, 141 between cylinders 2 and 4. One set of cams 139, 141 are phased 90° relative to the cams of the other set.

Means is provided to lower the auxiliary pistons 74. This is accomplished by means of a hydraulic pump system 170 for each cylinder. Each pipe 86 is part of the hydraulic system of one cylinder.

Figures 5A, 5B, 5C, 5D, 5E:
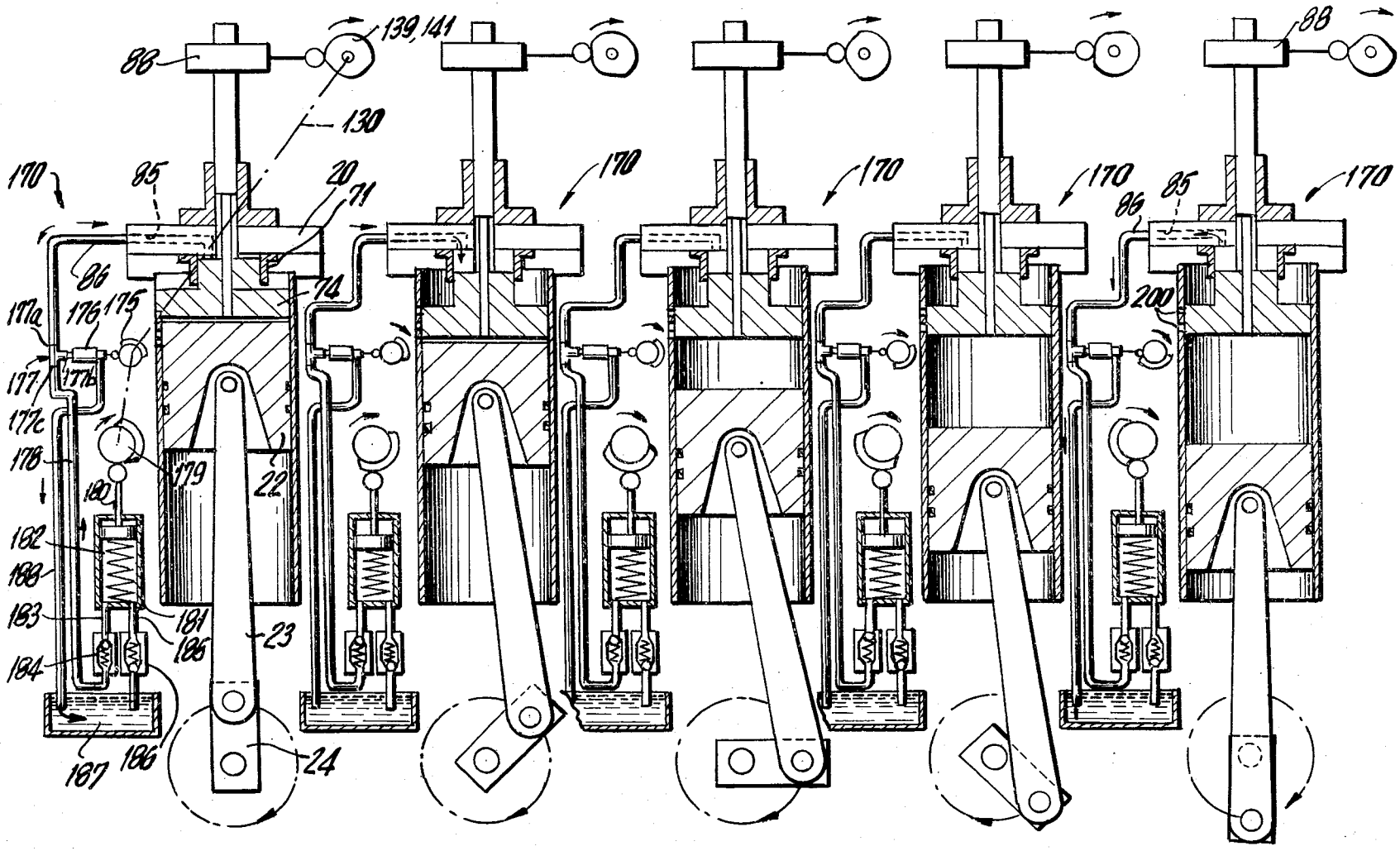

Attention is now directed to FIG. 5*a* which diagramatically shows one of the cylinders in a position with the main piston 22 and the auxiliary piston 74 both in the upper end of the cylinder. The dot-dash lines of FIG. 5*a* indicate sleeve cam shaft 130, with cams 139, 141 thereon in position to actuate the gas valves 88 of the cylinder shown in FIG. 5*a*.

In FIG. 5*a* numeral 175 indicates a cam on said cam shaft, for actuating a hydraulic valve 176. Oil pipe 86 is connected to one branch 177*a* of a T-fitting 177. One end of the valve 176 connects to another branch 177*b* of said fitting 177. Another oil pipe 178 connects to the third branch 177*c* of the T-fitting 177.

On shaft 130 is a second oil cam 179 to actuate a piston 180 in an oil pump 181. A coil compression spring 182 in the pump is interposed between the piston 180 and the lower end of the pump. An oil pipe 183 connects to a one way check valve 184 which in turn is connected to one end of oil pipe 178. The arrangement is such that oil can only be pumped down from the oil pump through check valve 184 to pipe 178. Said pump 181 is also connected by a pipe 185 and a check valve 186 to a reservoir 187. Oil can only be sucked up through check valve 186 into the pump, but cannot pass down from the pump to the reservoir through said valve 186.

The opposite end of valve 176 connects to a pipe 188. Said pipe 188 leads down to the reservoir 187. The valve 176 (see FIG. 6) has a valve seat 190 on which a ball 191 is seated. A coil compression spring 192 biases the ball onto the seat 190. The seat is located between the pipes 178 and 188. A pin 193 fixed to ball 191 passes through the valve. When the cam 179 presses the pin 193 to the left, looking at FIGS. 5*a* and 6, oil from pipe 86 can flow through valve 176 to pipe 188, so that oil can flow from the interior of sleeve 71 back to reservoir 187. When cam 175 is not pressing against pin 193, the valve seat 190 is closed and pressure of the cam 179 on piston 180 will cause oil to be pressed down through pipe 183, valve 184 and pipe 178 to pipe 86 and into the chamber formed by sleeve 171, to depress the auxiliary piston 74. When pressure of cam 179 on piston 180 is relieved, spring 182 presses piston 180 upwardly to suck oil from reservoir 187 through valve 186 into the oil pump 181.

Figure 2:
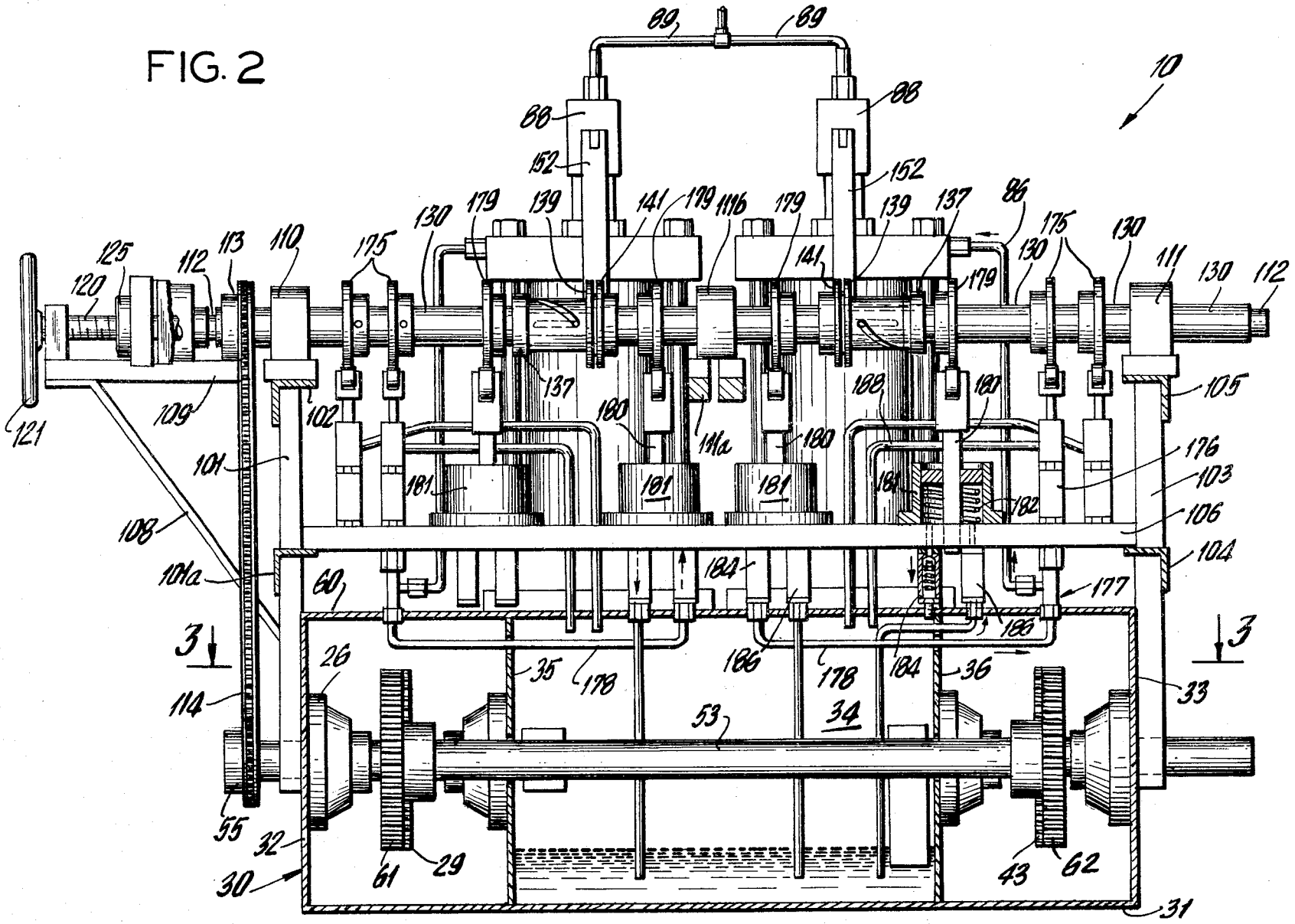
FIG. 2 is a cross-sectional view taken on line 2—2 of FIG. 1.

The oil system is shown diagramatically in FIG. 5*a*, but the oil systems are also shown in FIG. 2. In said FIG. 2, there are shown two cams 139, 141, on the cam shaft 130, four cams 179, four cams 175 on said cam shaft and four pumps 181.

The gas valves 88 are one way valves. They are closed when the cam is not operating the air valve (when rollers 154 are contacting the part-circular edge portions 139*a*, 141*a* of combined cams 139, 141). The gas valve is open when the roller 154 contacts cam depression edges 139*b*, 141*b* between the part circular edges. In FIG. 5*a*, the gas valve is closed, but is about to be opened. The main piston 22 has been dragged up by gas pressure in another cylinder. The piston 180 in the oil pump is up so that no oil is being pumped and the chamber of sleeve 71 is closed, and the auxiliary piston is up. The main piston is dragged from position of FIG. 5*a* to position of FIG. 5*b* through an angle of 45° of the crank shaft which is connected to the connecting rod of the cylinder. Since the piston is dragged, it moves down to the position of FIG. 5*b*. During this period the cam 179 depresses piston 180 and oil is pumped through pipes 178 and 86 to fill the space in sleeve 71 and the auxiliary piston 74 comes down to the position of FIG. 5*b*. That is as far down as the auxiliary piston can descend, because of pump 181 (FIG. 4). During this time, cam 175 has not actuated pin 193. Also upon reaching the position of FIG. 5*b*, the gas valve opens and gas under pressure comes down through passage 83 to move the main piston down to the position of FIG. 5*c*. This pressure stroke moves the crank shaft to horizontal position. The gas continues to come down and the main piston 22 moves to the position of FIG. 5*d*, completing a power stroke of 90° or thereabout, depending on adjustment of cam-shaft 130. In the FIG. 5*d* position, the gas valve closes but the piston still moves down to position of FIG. 5*e* with the crank extending down. In this position cam 175 pushes pin 193 and cam 179 is off the pump piston thereby allowing the pump piston to move up and suck oil into the pump chamber and allow oil to move from pipe 86 through valve 176 to the reservoir.

The crank has now moved 180° and is then dragged through another 180° back to the position of FIG. 5*a* by operation of the other cylinders. When the auxiliary piston moves down, sau ⅝ inch under force of oil pressure, it stops and is locked in position by virtue of check valves 176, 184. Therefore gas pressure in the cylinder cannot return it upwardly in positions of FIGS. 5*b*, 5*c*, 5*d*.

In position of FIG. 5*d*, the gas pressure is cut off, but the piston continues to go down because it begins to be dragged by another cylinder, and also because the gas in the cylinder still has pressure and expands, although reduced because of increased space or volume, going to position of FIG. 5*e*.

When the bottom of the cylinder is reached, the valve 176 in the oil or hydraulic system opens to the oil cylinder and to reservoir, and the compressed gas in the main cylinder has enough pressure to lift the auxiliary piston. Holes 200 (FIG. 5*e*) in the cylinder allow gas in the main cylinder to exhaust. The holes 200 are placed to be covered by the auxiliary piston when said auxiliary piston is in its down position.

When position of FIG. 5*e* is reached the next pistons to operate bring the piston from position of FIG. 5*e* back to position of FIG. 5*a*.

With this arrangement, you do not have to supply gas under pressure in position of FIG. 5*a*. Pressure begins at position of FIG. 5*b* thus saving considerable volume of gas under pressure. For pressure, liquid nitrogen in a cryogenic container can be employed. The liquid can be expanded through an evaporator as shown in FIG. 11.

This engine has many advantages. It is not intended to compete with a gasoline engine but it does compete favorably with a battery driven engine. it creates no pollution. No preheating is necessary. When a vehicle with this engine stops for traffic, the engine stops and hence no propellant is wasted. The operation of the engine is not affected by heat or cold, as with a battery operated engine. This engine eliminates recharging time of batteries. There is nothing to burn out and no danger of fire. There are no electrical parts to the engine. There is no necessity for a battery to start up the engine. It is a cold running engine. This engine, furthermore, is capable of extremely high torques at zero or very low speeds. You build up torque as you start supply of gas pressure. It is economical to operate.

Liquid nitrogen as manufactured today may be used. Such present day manufacture uses cascade system with nitrogen taken from the atmosphere and then returned to the atmosphere, so that nothing is taken out of the atmosphere. It is furthermore simple to dispense the nitrogen. The nitrogen moreover is nonexplosive and non-flammable and hence safer to use.

The principal of the auxiliary piston if applied to a gasoline engine, allows firing stroke of the main piston to take place at 45° angularly from top dead center. The 90° pressure stroke of each cylinder would then start from 45° above horizontal, so that greater torque is utilized. The auxiliary piston can, in such case, be actuated hydraulically as shown, or mechanically or any other suitable manner, resulting in saving of fuel and higher efficiency.

Adjust cams to start engine by opening to full 90°. While running, by turning wheel 121 threaded rod 120 is pulled through fixed bearing 119 to pull rod 112 to the left looking at FIG. 1. Rod 112 rotates sleeve 134 fixed to cam 139 and changes the angular relation between cam 139 and cam 141.

One set of cams 139, 141 is disposed between cylinders 1 and 3. The other set of cams 139, 141 is disposed between cylinders 2 and 4 is phased 90° from the first set, in lagging relation to said first set, so that the order of pressure in the cylinders is cylinders 1, 2, 3, 4. Cylinders 1 and 3 are pressured at 180° phase, and operated by the same set of cams 139, 141, whereas cylinders 2 and 4 are pressured 180° apart by the other set of cams 139, 141.

It will thus be seen that there is provided a device in which the several objects of this invention are achieved and which is well adapted to meet the conditions of practical use.

As various possible embodiments might be made of the above invention, and as various changes might be made in the embodiment above set forth, it is to be understood that all matter herein set forth or shown in the accompanying drawings is to be iterpreted as illustrative.

I claim:

1. An engine comprising a cylinder, a main piston slidable in said cylinder, a head fixed to the top of said cylinder, an auxiliary piston slidable in said cylinder, above said main piston and below said head, pressure actuated means to slidably move said main piston in said cylinder, and pressure actuated means to slidably move said auxiliary piston in said cylinder, a crankshaft, and connecting rod means to connect said crankshaft to said main piston for rotating said crankshaft as said main piston moves in said cylinder, means to actuate said means to slidably move said main piston, in sequence with rotation of said crankshaft, and means to actuate said means to slidably move said auxiliary piston, in sequence with the rotation of said crankshaft.

2. The combination of claim 1, said pressure means to move said main piston comprising gas pressure actuated means.

3. The combination of claim 2, said means to move said auxiliary piston comprising hydraulically actuated means.

4. The combination of claim 1, means to provide a supply of non-explosive gas propellant in a liquid state, means to transform said gas in liquid state to a gaseous state under pressure and to then supply said gas in a gaseous state under pressure to said means for moving said main piston.

5. The combination of claim 1, a cam shaft, means to connect said crankshaft to said cam shaft, and means controlled by said cam shaft to control operation of said means to slidably move said main piston in sequence with rotation of the crank shaft and also to control operation of the means to slidably move said auxiliary piston in sequence with the rotation of said crank shaft.

6. The combination of claim 1, said means to slidably move the main piston comprising a non-explosive gas propellant.

7. An engine comprising a cylinder, a main piston slidable in said cylinder, a head fixed to the top of said cylinder, an auxiliary piston slidable in said cylinder, above said main piston and below said head, pressure actuated means to slidably move said main piston in said cylinder, and pressure actuated means to slidably move said auxiliary piston in said cylinder, a crankshaft, and connecting rod means to connect said crankshaft to said main piston for rotating said crankshaft as said main piston moves in said cylinder, means to actuate said means to slidably move said main piston, in sequence with rotation of said crankshaft, and means to actuate said means to slidably move said auxiliary piston, in sequence with the rotation of said crankshaft, said pressure means to move said main piston comprising gas pressure actuated means, said means to move said auxiliary piston comprising hydraulically actuated means, said gas pressure actuated means comprising a valve means to permit supply of gas under pressure to flow to the cylinder at the top of said main piston and below the auxiliary piston, said hydraulically actuated means comprising a reservoir for hydraulic medium, a pump having means to receive hydraulic medium from said reservoir, and means to pump said medium to said engine between said head and said auxiliary piston to move said auxiliary piston, means to actuate said valve means in sequence, with the rotation of said crank shaft, and means to actuate said hydraulically actuated means in sequence with rotation of said crank shaft.

8. The combination of claim 7, said means to actuate said valve means comprising first cam means to control the valve means which permits supply of gas under pressure to the cylinder at the top of said main piston.

9. The combination of claim 8, and said means to actuate said hydraulically actuated means comprising second cam means to control operation of said pump.

10. The combination of claim 9, a cam shaft, and means to mount said first cam means and second cam means on said cam shaft, and means driven by said crank shaft to drive said cam shaft.

11. The combination of claim 10, and means to permit hydraulic medium to flow from above said auxiliary piston back to said reservoir and including a valve means, and a third cam means to control the operation of said last mentioned valve means, said third cam means being mounted on said cam shaft.

12. The combination of claim 11, and means operable while said cam shaft is being rotated and without stopping rotation of said cam shaft, to vary the angle of rotation of said first cam means during which the gas pressure valve means is actuated for each revolution thereof.

13. The combination of claim 7, in which said engine is an automotive engine.

14. An engine comprising a cylinder, a main piston slidable in said cylinder, a head fixed to the top of said cylinder, an auxiliary piston slidable in said cylinder, above said main piston and below said head, pressure actuated means to slidably move said main piston in said cylinder, and pressure actuated means to slidably move said auxiliary piston in said cylinder, a crankshaft, and connecting rod means to connect said crankshaft to said main piston for rotating said crankshaft as said main piston moves in said cylinder, means to actuate said means to slidably move said main piston, in sequence with rotation of said crankshaft, and means to actuate said means to slidably move said auxiliary piston, in sequence with the rotation of said crankshaft, said pressure means to move said main piston comprising gas pressure actuated means, said means to move said auxiliary piston comprising hydraulically actuated means, said gas pressure actuated means comprising valve means mounted on said head, to permit supply of gas under pressure to the top of said main piston, a cam shaft, a cam on said cam shaft, driven means to connect said crank shaft to said cam shaft, and means to adjust the effective angular extent of said cam, without stopping rotation of said cam and said cam shaft, said cam comprising a pair of telescoping sleeves non-rotatably and slidably mounted on said cam shaft, a pair of coaxial cam sections fixed on said sleeves, respectively, and said means to adjust the effective angular extent of the cam comprising means to cause relative angular rotation between said sleeves and their sections and sliding movement of both said sleeves relative to the cam shaft while said cam sections and cam shaft are rotating, said sleeves being non-slidable one relative to the other.

15. An engine comprising a pair of rows of cylinders, with the cylinders of one row being alinged with the cylinders of the other row, a main piston slidable in each cylinder, a head fixed to one end of each cylinder, an auxiliary piston slidable in each cylinder, between the main piston in said cylinder, and the head of said cylinder, a common crank shaft, drive means to connect said main pistons to said crank shaft, a cam shaft between said rows of cylinders, a valve on each cylinder communicating with the interior of said cylinder between the main piston and the auxiliary piston of said cylinder, means to supply non-explosive gas propellant to said valves, cam means on said cam shaft to open said valves during predetermined angle of rotation of the cam means, in predetermined sequence, means to connect said crank shaft to said cam shaft for driving said cam shaft, said cam means comprisng a cam on said cam shaft between each pair of aligned cylinders, means to permit gas propellant to pass through said valves when they are open, to the interior of the cylinders to move said pistons in sequence with the rotation of said crank shaft.

16. The combination of claim 15, in which said engine is an automotive vehicle engine.

17. The combination of claim 15, in which the gas propellent comprises liquid gas and means to transform the liquid gas to gaseous state under pressure, prior to feeding said gas to said cylinders.

18. The combination of claim 15, and means to move the auxiliary pistons sequentially with the crank shafts in said cylinders.

19. The combination of claim 11, and means to vary the angle of each cam during which the valves controlled by said cam are open.

20. The combination of claim 19, and means to operate said means to vary said angle while said cam shaft is rotating.

21. An engine comprising a cylinder, a main piston slidable in said cylinder, a head fixed to the top of said cylinder, an auxiliary piston slidable in said cylinder, above said main piston and below said head, pressure actuated means to slidably move said main piston in said cylinder, and pressure actuated means to slidably move said auxiliary piston in said cylinder, a crankshaft, and connecting rod means to connect said crankshaft to said main piston for rotating said crankshaft as said main piston moves in said cylinder, means to actuate said means to slidably move said main piston, in sequence with rotation of said crankshaft, and means to actuate said means to slidably move said auxiliary piston, in sequence with the rotation of said crankshaft, said pressure means to move said main piston comprising gas pressure actuated means, said means to move said auxiliary piston comprising hydraulically actuated means, said gas pressure actuated means comprising valve means mounted on said head, to permit supply of gas under pressure to said cylinder at the upper side of said main piston, a cam shaft, means to mount said cam shaft for both rotation and axial movement, a sleeve on said cam shaft, said sleeve being formed with a longitudinal slot, a first cam fixed on said sleeve, a pin on said crank shaft passing through said slot, a second sleeve rotatable on said first sleeve and having a helical slot crossing said longitudinal slot, said pin engaging in said helical slot, and a second cam on said second sleeve in facing relation to said first cam, follower means on said valve means to engage edges of both said cams, and means to connect said crank shaft to said cam shaft for rotating the latter.

22. The combination of claim 21, and means to move said cam shaft axially while said cam shaft is being rotated, to cause said second sleeve to rotate relative to said first sleeve and cam shaft.

23. The combination of claim 22, said first and second cams having similarly shaped outer edges.

24. An engine comprising a cylinder, a main piston slidable in said cylinder, a head fixed to the top of said cylinder, an auxiliary piston slidable in said cylinder, above said main piston and below said head, pressure actuated means to slidably move said main piston in said cylinder, pressure actuated means to slidably move said auxiliary piston in said cylinder, a crankshaft, and connecting rod means to connect said crankshaft to said main piston for rotating said crankshaft as said main piston moves in said cylinder, said cylinder having port means to open the inside of the cylinder to the atmosphere, said auxiliary piston being positioned to cover said port means in one relative position of said pistons, and being positioned to uncover said port means in another relative position of said pistons.

25. The combination of claim 24, said pressure means to move said main piston comprising gas pressure actuated means, said means to move said auxiliary piston comprising hydraulically actuated means, said gas pressure actuated means comprising a valve means to permit supply of gas under pressure to flow to the cylinder at the top of said main piston and below the auxiliary piston, said hydraulically actuated means comprising a reservoir for hydraulic medium, a pump having means to receive hydraulic medium from said reservoir, and means to pump said medium to said engine between said head and said auxiliary piston, to move said auxiliary piston, means to actuate said valve means in sequence with the rotation of said crank shaft and means to actuate said hydraulically actuated means in sequence with rotation of said crank shaft.

26. The combination of claim 25, said means to actuate said valve means comprising first cam means to control the valve means which permits supply of gas under pressure to the cylinder at the top of said main piston.

27. The combination of claim 26, and said means to actuate said hydraulically actuated means comprising second cam means to control operation of said pump.

28. The combination of claim 27, a cam shaft, and means to mount said first cam means and second cam means on said cam shaft, and means driven by said crank shaft to drive said cam shaft.

29. The combination of claim 28, and means to permit hydraulic medium to flow from above said auxiliary piston back to said reservoir and including a valve means, and a third cam means to control the operation of said last mentioned valve means, said third cam means being mounted on said cam shaft.

30. The combination of claim 29, and means operable while said cam shaft is being rotated and without stopping rotation of said cam shaft, to vary the angle of rotation of said first cam means during which the gas pressure valve means is actuated for each revolution thereof.

31. An engine comprising a pair of rows of cylinders, a main piston slidable in each cylinder, a head fixed to one end of each cylinder, an auxiliary piston slidable in each cylinder and located between the main piston in said cylinder and the head of said cylinder, a crankshaft, a cam shaft, cam means on said cam shaft, means to connect said crankshaft to said cam shaft for simultaneous rotation, and means controlled by said cam means, to supply fluid under pressure between the auxiliary piston of each cylinder and the main piston of said cylinder, to move said main piston in sequence with rotation of said crankshaft, and means controlled by said cam shaft to supply fluid under pressure between the head of each cylinder and the auxiliary piston of said cylinder, to move said auxiliary piston in sequence with the operation of said crankshaft.

* * * * *